US007497430B2

(12) United States Patent
Kusumi

(10) Patent No.: US 7,497,430 B2
(45) Date of Patent: Mar. 3, 2009

(54) IMAGE FORMING APPARATUS, IMAGE FORMING METHOD, AND SHEET FEEDING APPARATUS CAPABLE OF EFFECTIVELY FEEDING SHEETS

(75) Inventor: Tadashi Kusumi, Kawasaki (JP)

(73) Assignee: Ricoh Co., Ltd., Tokyo (JP)

( * ) Notice: Subject to any disclaimer, the term of this patent is extended or adjusted under 35 U.S.C. 154(b) by 155 days.

(21) Appl. No.: 11/376,123

(22) Filed: Mar. 16, 2006

(65) Prior Publication Data

US 2006/0220297 A1 Oct. 5, 2006

(30) Foreign Application Priority Data

Mar. 16, 2005 (JP) ..... 2005-074359

(51) Int. Cl.
*B65H 5/00* (2006.01)

(52) U.S. Cl. ..... 271/10.03; 271/110

(58) Field of Classification Search ..... 271/10.03, 271/10.01, 10.09, 10.13, 110, 114, 117, 126, 271/127

See application file for complete search history.

(56) References Cited

U.S. PATENT DOCUMENTS

| | | | | |
|---|---|---|---|---|
| 3,806,112 | A | 4/1974 | Melby et al. | |
| 4,566,684 | A | 1/1986 | Gysling | |
| 4,580,890 | A | 4/1986 | Sugizaki et al. | |
| 5,172,900 | A | 12/1992 | Uno et al. | |
| 6,062,557 | A | 5/2000 | Kusumi | |
| 6,161,829 | A | 12/2000 | Kusumi | |
| 2004/0119224 | A1 * | 6/2004 | Otsuka | 271/10.03 |

FOREIGN PATENT DOCUMENTS

| | | |
|---|---|---|
| EP | 0 943 567 A2 | 9/1999 |
| EP | 0 949 171 A1 | 10/1999 |
| JP | 2002-265083 | 9/2002 |
| JP | 2005-22792 | 1/2005 |
| JP | 2005-213039 | 8/2005 |

OTHER PUBLICATIONS

Patent Abstracts of Japan, JP 58-011447, Jan. 22, 1983.

* cited by examiner

*Primary Examiner*—Kaitlin S Joerger
(74) *Attorney, Agent, or Firm*—Oblon, Spivak, McClelland, Maier & Neustadt, P.C.

(57) ABSTRACT

An image forming apparatus includes image forming and sheet feeding mechanisms. The sheet feeding mechanism includes a bottom plate, a first roller, a separator including second and third rollers, and a sensor. The bottom plate loads sheets. The first roller feeds an uppermost sheet of the sheets loaded on the bottom plate. The separator separates the uppermost sheet from the other sheets when a plurality of sheets are fed by the first roller. The sensor is disposed between heads of the sheets loaded on the bottom plate and the separator and detects the uppermost sheet fed by the first roller. The image forming apparatus further includes a controller for driving the first roller to feed a next uppermost sheet loaded on the bottom plate when the sensor does not detect the next uppermost sheet when a tail portion of the previous sheet passes the separator.

7 Claims, 10 Drawing Sheets

IMAGE FORMING APPARATUS, IMAGE FORMING METHOD, AND SHEET FEEDING APPARATUS CAPABLE OF EFFECTIVELY FEEDING SHEETS

CROSS-REFERENCE TO RELATED APPLICATION

The present application is based on and claims priority to Japanese patent application No. 2005-074359 filed on Mar. 16, 2005 in the Japan Patent Office, the entire contents of which are hereby incorporated herein by reference.

BACKGROUND OF THE INVENTION

1. Field of the Invention

The present invention relates to an image forming apparatus, an image forming method, and a sheet feeding apparatus, and more particularly to an image forming apparatus, an image forming method, and a sheet feeding apparatus capable of effectively feeding sheets.

2. Description of the Background Art

A background image forming apparatus, such as a copying machine, a printer, or a facsimile machine, generally includes a sheet feeding apparatus for feeding sheets one by one from a paper tray. The sheet feeding apparatus generally includes a mechanism for separating an uppermost sheet from the other sheets fed from the paper tray and feeding only the uppermost sheet when a plurality of sheets are fed from the paper tray. As one of the mechanism, a friction reverse roller method is known. The sheet feeding apparatus using the friction reverse roller method includes a feeding roller and a separating roller as the mechanism for separating the uppermost sheet from the other sheets fed from the paper tray and feeding only the uppermost sheet.

FIG. 1 illustrates a sheet feeding apparatus 20*b* which is one example of the sheet feeding apparatus using the friction reverse roller method. The sheet feeding apparatus 20*b* includes a bottom plate 9*b*, a pick-up roller 4*b*, a feeding roller 2*b*, a separating roller 3*b*, a grip roller 5*b*, and a sensor 6*b*.

The bottom plate 9*b* is disposed in a paper tray 1*b* of the image forming apparatus and loads sheets S. The pick-up roller 4*b* feeds the sheets S loaded on the bottom plate 9*b* from the paper tray 1*b*. The feeding roller 2*b* rotates in a sheet conveyance direction. The separating roller 3*b* faces and pressingly contacts the feeding roller 2*b* and is driven to rotate in a direction opposite the sheet conveyance direction. The bottom plate 9*b* moves upward in a direction U to cause an uppermost sheet S of the sheets S loaded on the bottom plate 9*b* to contact the pick-up roller 4*b*.

The pick-up roller 4*b* is connected to the feeding roller 2*b* via gears and rotates to feed the uppermost sheet S toward a nip formed between the feeding roller 2*b* and the separating roller 3*b*. The feeding roller 2*b* further feeds the sheet S toward the grip roller 5*b*. When the sheet S reaches the grip roller 5*b*, the pick-up roller 4*b* moves away from the sheet S. The feeding roller 2*b* stops rotating before a tail portion of the sheet S passes the nip formed between the feeding roller 2*b* and the separating roller 3*b* to prevent the rotating feeding roller 2*b* from successively feeding a next uppermost sheet S of the sheets S loaded on the bottom plate 9*b* and thereby interfering with proper image forming operations.

The feeding roller 2*b* includes a roller, a shaft, and a one-way clutch. The clutch switches on and off connection between the roller and the shaft. When the clutch switches off the connection, the shaft does not rotate the roller because a driving force of the shaft is not transmitted to the roller.

Therefore, the feeding roller 2*b* is driven to rotate in the sheet conveyance direction by the sheet S fed by the grip roller 5*b* without disturbing proper conveyance of the sheet S.

The sensor 6*b* is disposed downstream of the grip roller 5*b* in the sheet conveyance direction. When the sensor 6*b* detects a head of the previous sheet S, feeding of the next uppermost sheet S starts so that the next sheet S is stably conveyed. The pick-up roller 4*b* and the feeding roller 2*b* are driven at a predetermined timing when the next sheet P is fed to enable image forming operations at a predetermined print speed without contacting the tail of the previous sheet S.

The background image forming apparatus tends to suppress the speed at which the sheet S is fed during image forming so as to form a high-resolution image. However, the background image forming apparatus is still required to provide a higher print speed. To respond to such requirement, the distance between the sheet S and the next sheet S is reduced in the background image forming apparatus.

SUMMARY OF THE INVENTION

This specification describes a novel image forming apparatus. In one aspect of the present invention, the novel image forming apparatus includes an image forming mechanism configured to form a visible image using toner on a sheet according to image data and a sheet feeding mechanism configured to feed the sheet to the image forming mechanism.

The sheet feeding mechanism includes a bottom plate, a first roller, a separator including a second roller and a third roller, and a sensor. The bottom plate is configured to load sheets. The first roller is configured to feed an uppermost sheet of the sheets loaded on the bottom plate. The separator is configured to separate the uppermost sheet from the other sheets when a plurality of sheets are fed by the first roller. The second roller is configured to feed the uppermost sheet fed by the first roller. The third roller is disposed to pressingly contact the second roller. The sensor is disposed between the heads of the sheets loaded on the bottom plate and the separator and is configured to detect the uppermost sheet fed by the first roller.

The novel image forming apparatus further includes a controller configured to drive the first roller to feed a next uppermost sheet of the sheets loaded on the bottom plate when the sensor does not detect the next uppermost sheet when the tail portion of the previous sheet passes the separator.

This specification further describes a novel image forming method. In one aspect of the present invention, the novel image forming method includes forming a visible image using toner on a sheet according to image data and feeding the sheet for the image forming operation.

The feeding step includes the sub-steps of feeding with a first roller an uppermost sheet of sheets loaded on the bottom plate, feeding further with a second roller the uppermost sheet fed by the first roller with an assistance of a third roller which forms a separator together with the second roller, and detecting the uppermost sheet fed by the first roller with a sensor disposed between heads of the sheets loaded on the bottom plate and the separator.

The novel image forming method further includes driving the first roller to feed the next uppermost sheet of the sheets loaded on the bottom plate when the sensor does not detect the next uppermost sheet when a tail of the previous sheet passes the separator.

This specification further describes a novel sheet feeding apparatus. In one aspect of the present invention, the novel sheet feeding apparatus includes a bottom plate, a first roller, a separator including a second roller and a third roller, and a sensor.

The bottom plate is configured to load sheets. The first roller is configured to feed an uppermost sheet of the sheets loaded on the bottom plate. The separator is configured to separate the uppermost sheet from the other sheets when a plurality of sheets are fed by the first roller. The second roller is configured to feed the uppermost sheet fed by the first roller. The third roller is disposed to pressingly contact the second roller. The sensor is disposed between heads of the sheets loaded on the bottom plate and the separator and is configured to detect the uppermost sheet fed by the first roller.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
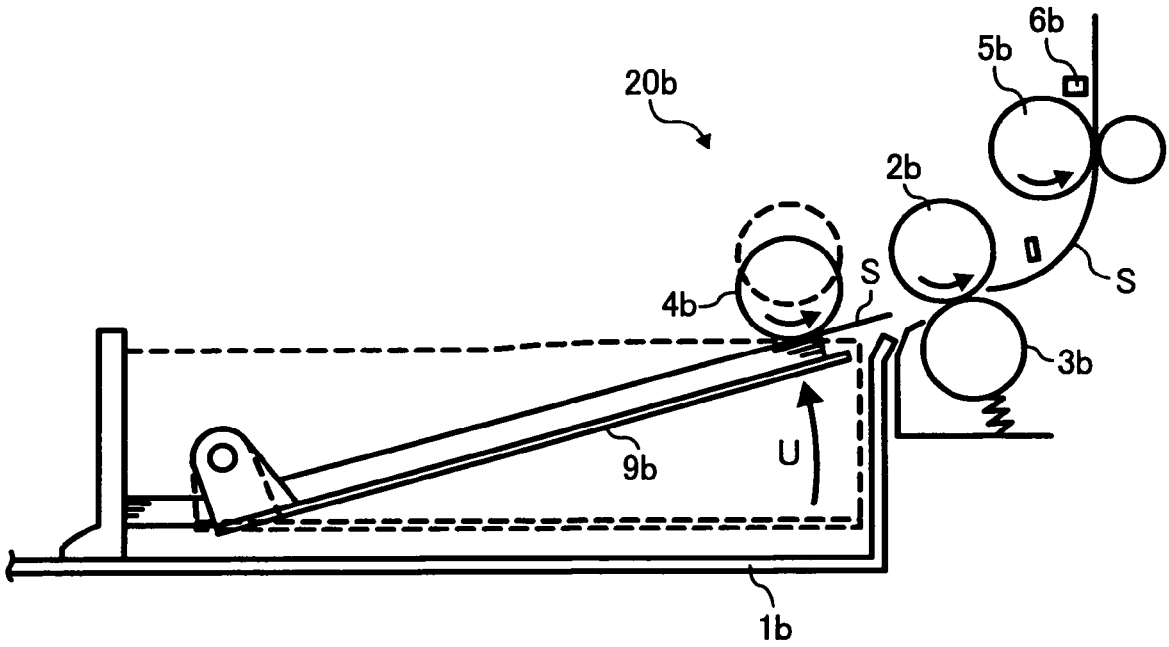
FIG. 1 BACKGROUND ART
FIG. 1 is a cross-sectional view of a background sheet feeding apparatus.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 2, an image forming apparatus 100 according to an exemplary embodiment of the present invention is explained.

Figure 2:
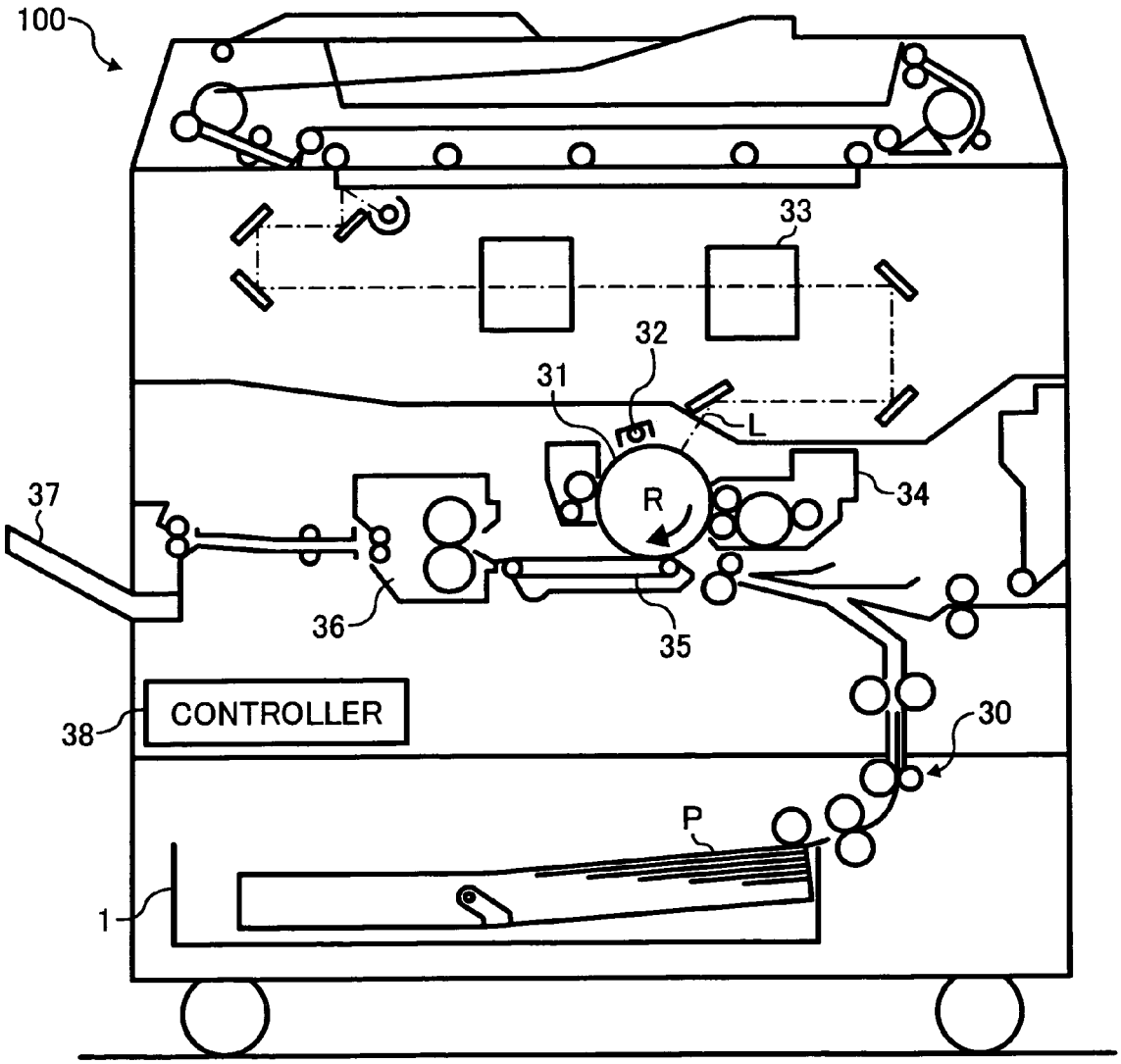
FIG. 2 is a cross-sectional view of an image forming apparatus according to an exemplary embodiment of the present invention.

As illustrated in FIG. 2, the image forming apparatus 100 includes a photoconductor 31, a charger 32, an optical system 33, a development unit 34, a paper tray 1, a sheet feeding apparatus 30, a transferor 35, a fixing unit 36, an output tray 37, and a controller 38.

The image forming apparatus 100 functions as a copying machine, a printer, a facsimile machine, or the like. The photoconductor 31 rotates in a rotating direction R. The charger 32 evenly charges a surface of the photoconductor 31. The optical system 33 guides light L according to image data onto the photoconductor 31 to form an electrostatic latent image on the photoconductor 31. The photoconductor 31 carries the electrostatic latent image. The development unit 34 visualizes the electrostatic latent image formed on the photoconductor 31 with toner to form a toner image on the photoconductor 31. The paper tray 1 loads sheets P. The sheet feeding apparatus 30 feeds the sheets P one by one from the paper tray 1 toward the transferor 35. The transferor 35 transfers the toner image formed on the photoconductor 31 onto the sheet P. The fixing unit 36 fixes the toner image on the sheet P. The output tray 37 receives the sheet P having the fixed toner image, which is sent from the fixing unit 36. The controller 38 controls operations of the image forming apparatus 100.

The photoconductor 31, the charger 32, the optical system 33, the development unit 34, the transferor 35, and the fixing unit 36 form an image forming mechanism for forming a visible image using toner on the sheet P according to image data. The paper tray 1 and the sheet feeding apparatus 30 form a sheet feeding mechanism for feeding the sheet P to the image forming mechanism.

Figure 3:
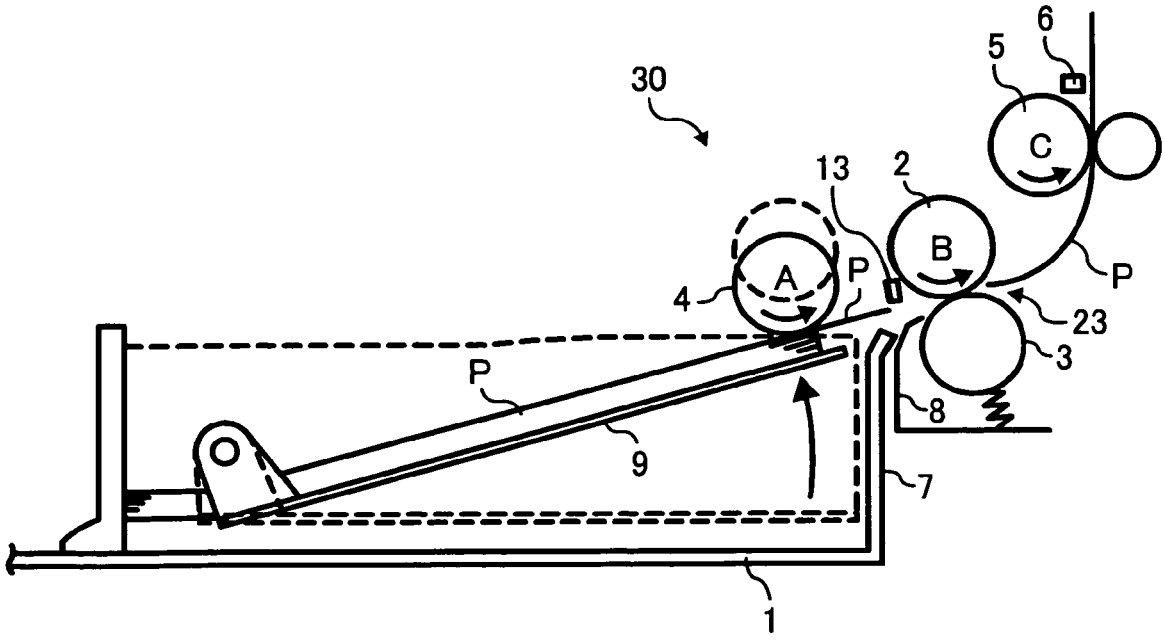
FIG. 3 is a cross-sectional view of an example sheet feeding apparatus of the image forming apparatus shown in FIG. 2.

As illustrated in FIG. 3, the paper tray 1 includes a side wall 7. The sheet feeding apparatus 30 includes a bottom plate 9, a pick-up roller 4, a guide 8, a sensor 13, a separator 23 including a feeding roller 2 and a separating roller 3, a grip roller 5, and a sensor 6.

The side wall 7 forms a wall of the paper tray 1, which faces the guide 8. Sheets P are loaded on the bottom plate 9. A force pushing the bottom plate 9 upward causes an uppermost sheet P of the sheets P loaded on the bottom plate 9 to contact the pick-up roller 4. The pick-up roller 4 is connected to the feeding roller 2 via gears and rotates in a rotating direction A to feed the uppermost sheet P toward the guide 8. The guide 8 guides the uppermost sheet P toward a nip formed between the feeding roller 2 and the separating roller 3. The sensor 13 is disposed between heads of the sheets P loaded on the bottom plate 9 and the nip formed between the feeding roller 2 and the separating roller 3 and detects the uppermost sheet P fed by the pick-up roller 4. The separator 23 separates the uppermost sheet P from the other sheets P, if accidentally fed by the pick-up roller 4 together with the uppermost sheet P, to feed only the uppermost sheet P toward the grip roller 5. The feeding roller 2 is disposed downstream of the pick-up roller 4 and rotates in a rotating direction B to feed the uppermost sheet P toward the grip roller 5. The separating roller 3 opposes to the feeding roller 2 to pressingly contact the feeding roller 2. A driving force is applied to the separating roller 3 in a direction opposite a sheet conveyance direction via a torque limiter (not shown). The grip roller 5 is disposed downstream of the feeding roller 2 and rotates in a rotating direction C to feed the uppermost sheet P. The sensor 6 is disposed downstream of the grip roller 5 and detects the head of the uppermost sheet P fed by the grip roller 5.

The following describes operations of the sheet feeding apparatus 30 when an image is to be formed on a single sheet P. The pick-up roller 4 feeds an uppermost sheet P of sheets P loaded on the bottom plate 9 to the separator 23. The separator 23 separates the uppermost sheet P from the other sheets P, if accidentally fed by the pick-up roller 4 together with the uppermost sheet P, so as to feed only the uppermost sheet P toward the grip roller 5.

The grip roller 5 further feeds the uppermost sheet P toward the sensor 6. The controller 38 stops driving the feeding roller 2 at a time T1 which is immediately before a tail portion of the uppermost sheet P passes the nip formed between the feeding roller 2 and the separating roller 3. The time T1 is calculated based on detection information of the head of the uppermost sheet P obtained by the sensor 6 and information about size of the uppermost sheet P preset.

The pick-up roller 4 moves away from the uppermost sheet P during a time period after the head of the uppermost sheet P passes a nip formed between the grip roller 5 and a roller opposing thereto until a time T2 which is before the tail of the uppermost sheet P passes a nip formed between the pick-up roller 4 and the uppermost sheet P.

The feeding roller 2 includes a one-way clutch. Therefore, while the shaft of the feeding roller 2 does not rotate after the controller 38 stops driving the feeding roller 2, the feeding roller 2 is driven to rotate in the direction B by the uppermost sheet P fed by the grip roller 5. The grip roller 5 feeds the sheet P toward a registration roller (not shown) for feeding the sheet P to the transferor 35 at a timing when a toner image is properly transferred onto the sheet P. Then, the sheet P is delivered onto the output tray 37 via the transferor 35 and the fixing unit 36.

The following discussion describes operations of the sheet feeding apparatus 30 when an image is to be formed on a plurality of sheets P. A first sheet P is conveyed as described above. Feeding of a second sheet P starts when the sensor 6 detects the head of the first sheet P so that the second sheet P is stably conveyed and hardly slipped. Thus, the controller 38 starts driving the pick-up roller 4 and the feeding roller 2 at a predetermined timing when the second sheet P is fed to enable image forming operations at a predetermined print speed without contacting the tail of the first sheet P as a controller of a background image forming apparatus does.

A distance needs to be provided between the first and second sheets P conveyed so that the sensor 6 can detect the distance in order to calculate the timing when the second sheet P is fed without contacting the tail of the first sheet P. Without the distance, the sensor 6 cannot detect whether the second sheet P contacts the tail of the first sheet P or not. The distance is preferably about 8 mm when a reflective sensor is used. The registration roller bends the first sheet P so that the head of the first sheet P hits the registration roller. Thus, the first sheet P, if obliquely conveyed, is properly oriented to be straight conveyed. When the tail of the first sheet P passes a roller (not shown) disposed immediately in front of the registration roller, the first sheet P is flattened. As a result, the distance is shortened by about 2 mm to about 6 mm.

When feeding starts, the head of the second sheet P has not passed the nip formed between the feeding roller 2 and the separating roller 3. Therefore, the nip formed between the feeding roller 2 and the separating roller 3 is a feeding start position located most downstream in the sheet conveyance direction. To feed the second sheet P at the timing when the second sheet P does not contact the tail of the first sheet P, feeding of the second sheet P starts when the first sheet P is conveyed for a length equivalent to the distance required between the first and second sheets P plus the distance shortened by the first sheet P flattened after the tail of the first sheet P passes the nip formed between the feeding roller 2 and the separating roller 3.

Actually, an extra length is added to the above-described length by considering a length caused by the slipping first and second sheets P. According to this non-limiting embodiment, feeding of the second sheet P starts at a time T3 when the tail of the first sheet P is conveyed by about 15 mm after passing the nip formed between the feeding roller 2 and the separating roller 3.

When feeding of the second sheet P starts at the time T3, the feeding start position varies by about 0 mm to about 30 mm in the background image forming apparatus. Therefore, the print speed corresponds to a distance between the first and second sheets P, which is calculated by adding a distance corresponding to a time period T10 to a distance of about 45 mm. The time period T10 represents a time period when the first sheet P stops at the registration roller and 45 mm is obtained by adding about 15 mm which corresponds to the time T3. According to this non-limiting embodiment, however, the sensor 13 is disposed between the heads of the sheets P loaded on the bottom plate 9 and the nip formed between the feeding roller 2 and the separating roller 3. Specifically, the sensor 13 is disposed about 12 mm in front of the nip formed between the feeding roller 2 and the separating roller 3.

When the sensor 13 detects the head of the second sheet P fed by friction between the first and second sheets P at a time T4 which is immediately after the tail of the first sheet P passes the sensor 13, the controller 38 stops driving the feeding roller 2 before the tail of the first sheet P passes the nip formed between the feeding roller 2 and the separating roller 3 and starts feeding the second sheet P at the time T3.

When the sensor 13 does not detect the head of the second sheet P at the time T4 which is immediately after the tail portion of the first sheet P passes the sensor 13, the controller 38 does not stop driving the feeding roller 2 and causes the pick-up roller 4 to contact the second sheet P placed on the bottom plate 9.

Figure 4A:
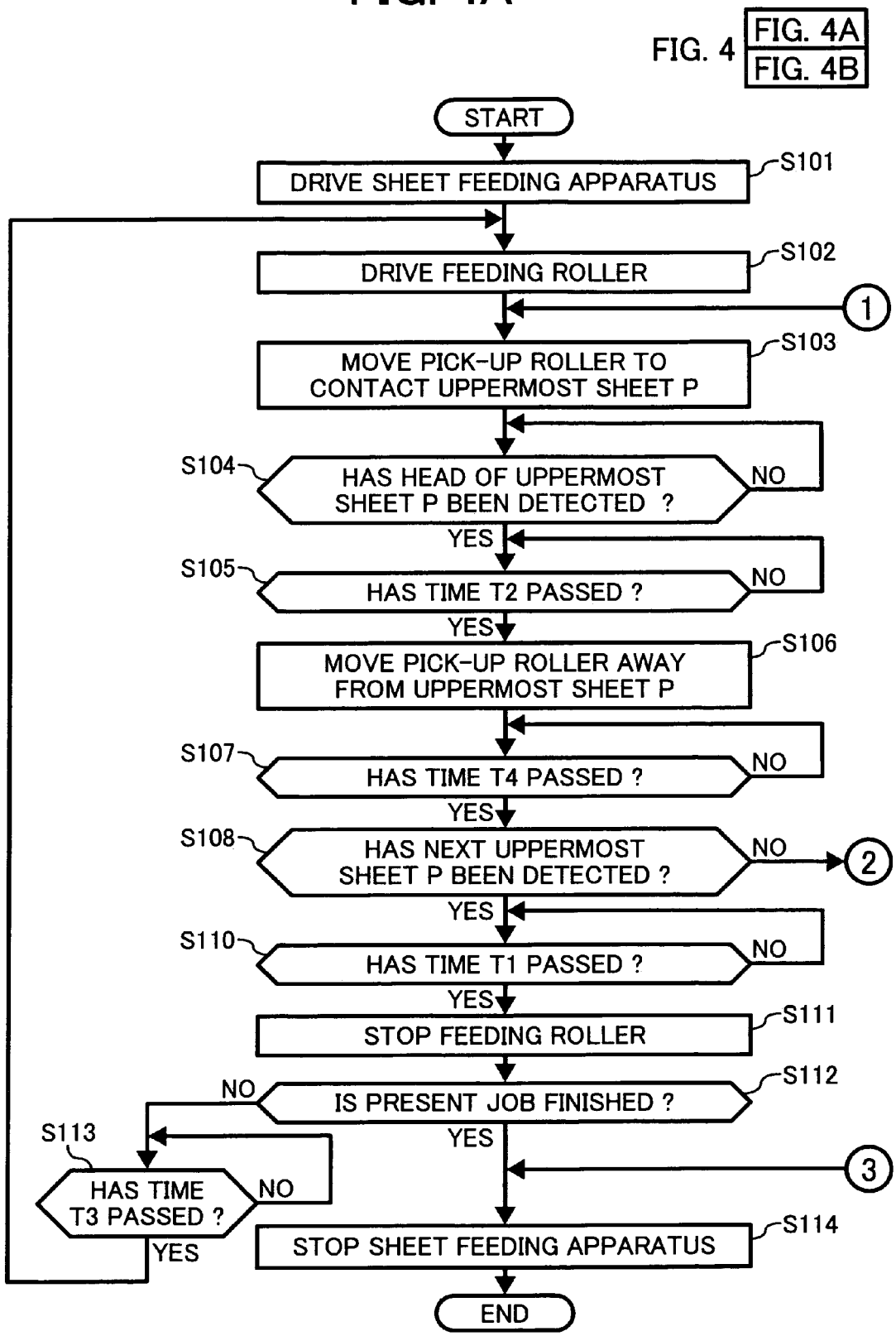
FIGS. 4A and 4B illustrate a flowchart of operations of the sheet feeding apparatus shown in FIG. 3.
Figure 4B:
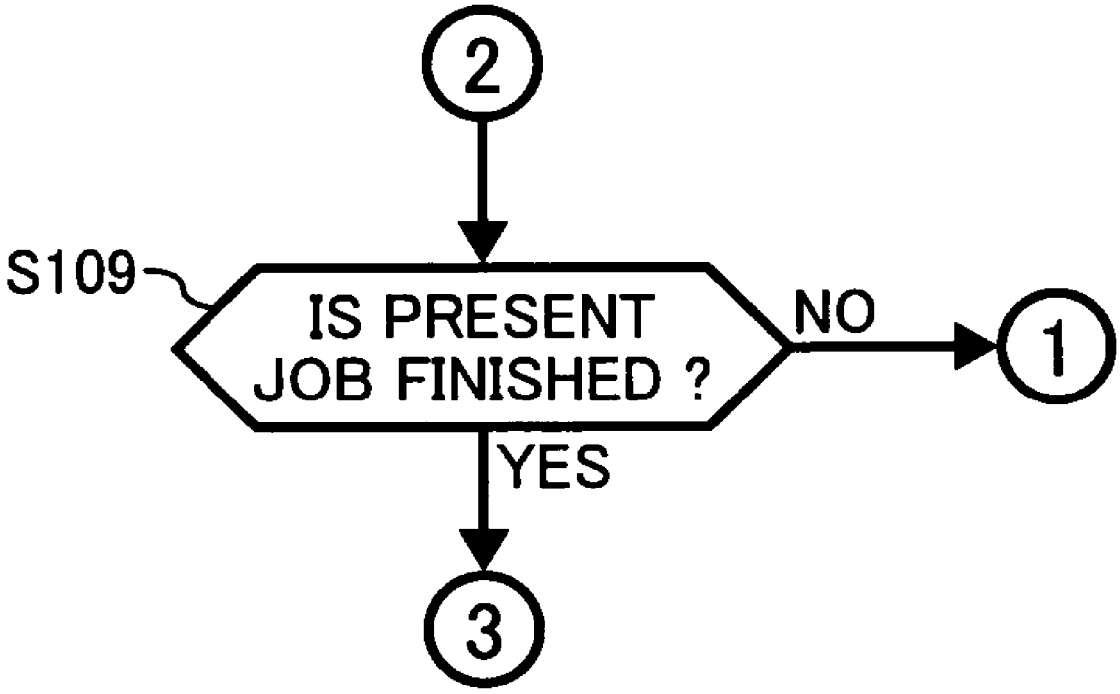

FIGS. 4A and 4B illustrate a flowchart of operations of the sheet feeding apparatus 30 according to this non-limiting embodiment of the present invention. In step S101, the sheet feeding apparatus 30 is driven. In step S102, the feeding roller 2 is driven. In step S103, the pick-up roller 4 contacts an uppermost sheet P (i.e., the first sheet P) of sheets P loaded on the bottom plate 9. The uppermost sheet P is fed by the pick-up roller 4, the feeding roller 2, the separating roller 3, and the grip roller 5. In step S104, it is determined whether the sensor 6 has detected the head of the fed first sheet P or not.

If YES is selected in step S104, whether the time T2 has passed or not is determined in step S105. If YES is selected in step S105, the pick-up roller 4 moves away from the uppermost sheet P in step S106. In step S107, it is determined whether the time T4 has passed or not. If YES is selected in step S107, it is determined whether the sensor 13 has detected a next uppermost sheet P (i.e., the second sheet P) or not in step S108. If NO is selected in step S108, it is determined whether a present job is finished or not in step S109. If YES is selected in step S109, the sheet feeding apparatus 30 stops in step S114. If YES is selected in step S108, it is determined whether the time T1 has passed or not in step S110. If YES is selected in step S110, the feeding roller 2 stops in step S111. In step S112, it is determined whether the present job is finished or not. If YES is selected in step S112, the sheet feeding apparatus 30 stops in step S114. If NO is selected in step S112, it is determined whether the time T3 has passed or not in step S113. If YES is selected in step S113, the feeding roller 2 is driven in step S102.

If the sensor 13 detects the second sheet P, the print speed corresponds to a distance between the first and second sheets P, which is calculated by adding a distance corresponding to the time period T10 to a distance of about 27 mm at a maximum. The time period T10 represents a time period when the first sheet P stops at the registration roller and 27 mm is obtained by adding 12 mm to 15 mm.

If the sensor 13 does not detect the second sheet P, the print speed corresponds to a distance between the first and second sheets P, which is calculated by adding a distance corresponding to a time period T11 and the distance corresponding to the time period T10 to a distance of about 12 mm at a minimum. Otherwise, the print speed corresponds to a distance between the first and second sheets P, which is calculated by adding the distance corresponding to the time period T11 and the distance corresponding to the time period T10 to a distance of about 30 mm at a maximum. The time period T11 represents a response time of the pick-up roller 4. The time period T10 represents a time period when the first sheet P stops at the registration roller. The distance of about 30 mm is formed between the head of the second sheet P placed on the bottom plate 9 and the nip formed between the feeding roller 2 and the separating roller 3.

If the time period T11 representing a response time of the pick-up roller 4 is equivalent to a time period required to convey the sheet P by about 3 mm, a minimum distance of about 15 mm can be kept. The print speed corresponds to a distance between the first and second sheets P, which is calculated by adding the distance corresponding to the time period T10 to a distance of about 33 mm. The time period T10 represents a time period when the first sheet P stops at the registration roller. Therefore, the distance between the first and second sheets P is by about 12 mm shorter in the sheet feeding apparatus 30 according to this non-limiting embodiment than in the background sheet feeding apparatus 20*b*. A constant-speed motor can be used as a driving motor because it is not necessary to feed the sheet P at an increased speed according to this non-limiting embodiment. The second sheet P is frequently fed by friction between the first and second sheets P when coarse sheets having varied friction coefficients are used as the first and second sheets P. When proper sheets are used as the first and second sheets P, the second sheet P is rarely fed by friction between the first and second sheets P. Therefore, the feeding roller 2 is driven on and off with a decreased frequency. When an electromagnetic clutch is used to drive both the feeding roller 2 and the grip roller 5, the decreased frequency for driving on and off the feeding roller 2 can prevent the life of the electromagnetic clutch from being shortened, resulting in improved reliability of the sheet feeding apparatus 30.

The sheet feeding apparatus 30 according to this non-limiting embodiment includes, as a friction reverse roller, the separating roller 3 which is driven in a direction opposite to the sheet conveyance direction. However, the sheet feeding apparatus 30 may include, as a friction reverse roller, a separating roller which prevents the second sheet P and following sheets P from being fed together with the first sheet P without being driven in the direction opposite to the sheet conveyance direction.

According to this non-limiting embodiment, when the sensor 13 does not detect the head of the second sheet P at the time T4 which is immediately after the tail portion of the first sheet P passes the sensor 13, the sensor 13 may not detect the head of the second sheet P even when a predetermined time period T5 elapses after the pick-up roller 4 contacts the second sheet P placed on the bottom plate 9. In this case, the controller 38 stops driving the feeding roller 2 and moves the pick-up roller 4 away from the second sheet P placed on the bottom plate 9. The controller 38 also causes a control panel (not shown) of the image forming apparatus 100 to display a message notifying an operator that no sheet is loaded on the paper tray 1.

Figure 5A:
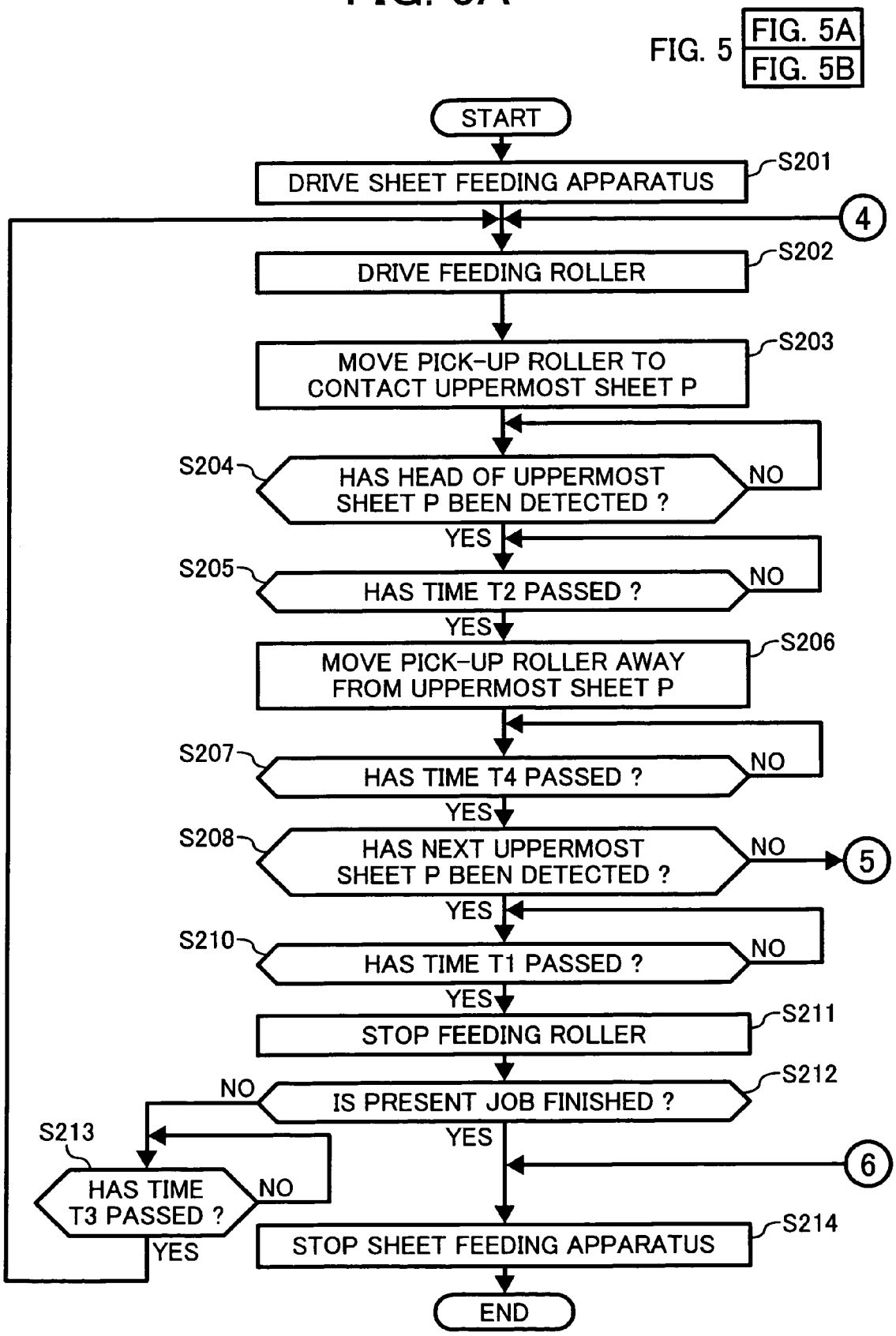
FIGS. 5A and 5B illustrate a flowchart of additional operations of the sheet feeding apparatus shown in FIG. 3.
Figure 5B:
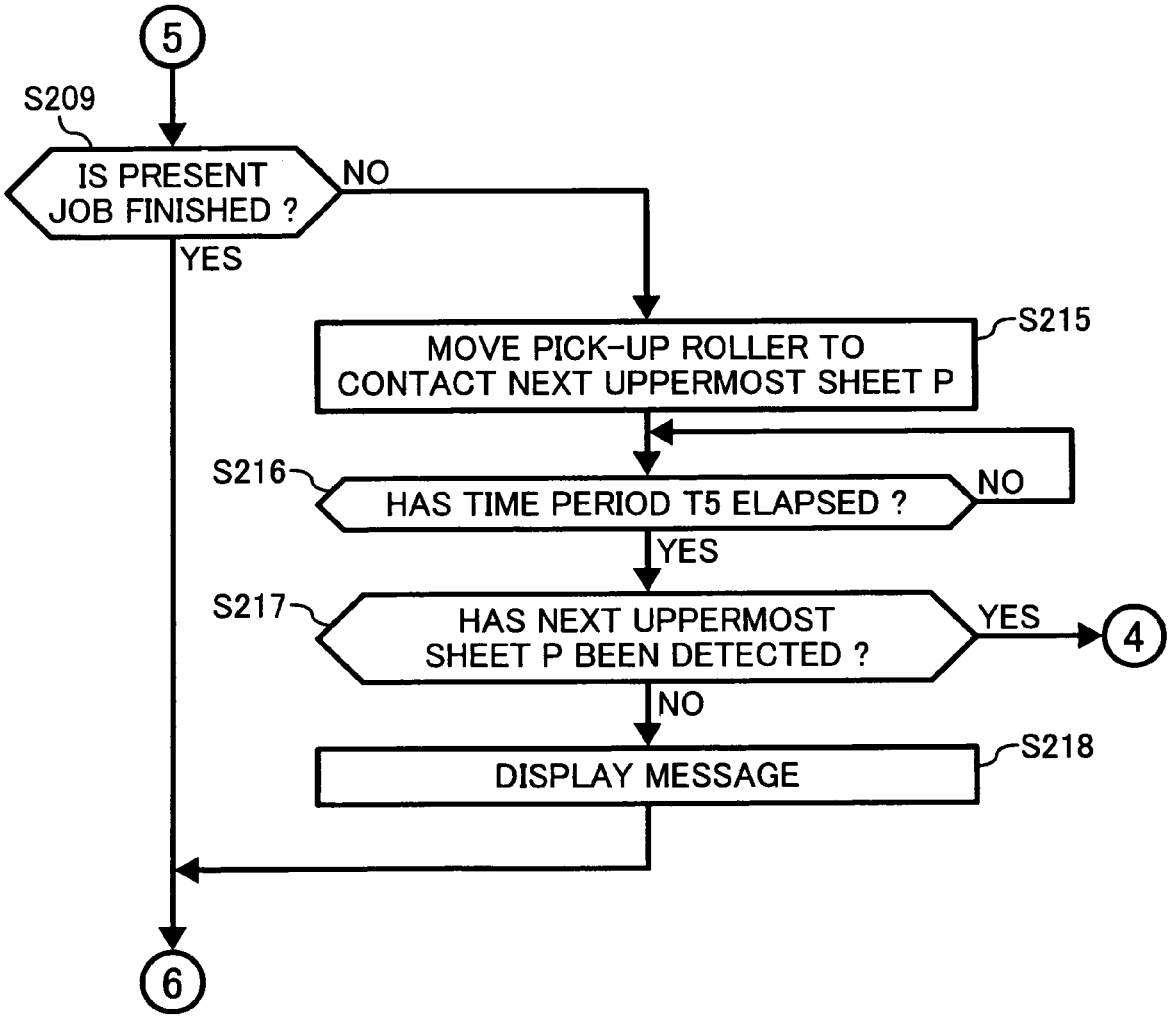

FIGS. 5A and 5B illustrate a flowchart of operations of the sheet feeding apparatus 30 when the sensor 13 does not detect the head of the second sheet P even when the time period T5 elapses after the pick-up roller 4 contacts the second sheet P placed on the bottom plate 9.

In step S201, the sheet feeding apparatus 30 is driven. In step S202, the feeding roller 2 is driven. In step S203, the pick-up roller 4 contacts an uppermost sheet P (i.e., the first sheet P) of sheets P loaded on the bottom plate 9. The first sheet P is fed by the pick-up roller 4, the feeding roller 2, the separating roller 3, and the grip roller 5. In step S204, whether the sensor 6 has detected the head of the fed first sheet P or not is determined. If YES is selected in step S204, it is determined whether the time T2 has passed or not is determined in a step S205. If YES is selected in step S205, the pick-up roller 4 moves away from the first sheet P in step S206. In step S207, it is determined whether the time T4 has passed or not. If YES is selected in step S207, it is determined whether sensor 13 has detected a next uppermost sheet P (i.e., the second sheet P) of the sheets P loaded on the bottom plate 9 or not in step S208. If NO is selected in step S208, it is determined whether the present job is finished or not in step S209. If YES is selected in step S209, the sheet feeding apparatus 30 stops in step S214. If YES is selected in step S208, it is determined whether the time T1 has passed or not in step S210. If YES is selected in step S210, the feeding roller 2 stops in step S211. In a step S212, it is determined whether the present job is finished or not. If YES is selected in step S212, the sheet feeding apparatus 30 stops in step S214. If NO is selected in step S212, it is determined whether the time T3 has passed or not in step S213. If YES is selected in step S213, the feeding roller 2 is driven in step S202.

If NO is selected in step S209, the pick-up roller 4 contacts the second sheet P placed on the bottom plate 9 in step S215. In step S216, it is determined whether the time period T5 has elapsed or not. If YES is selected in step S216, it is determined whether the sensor 13 has detected the second sheet P or not in step S217. If NO is selected in step S217, the message notifying the operator that no sheet is loaded on the paper tray 1 appears in step S218. If YES is selected in step S217, the feeding roller 2 is driven in step S202.

Figure 6:
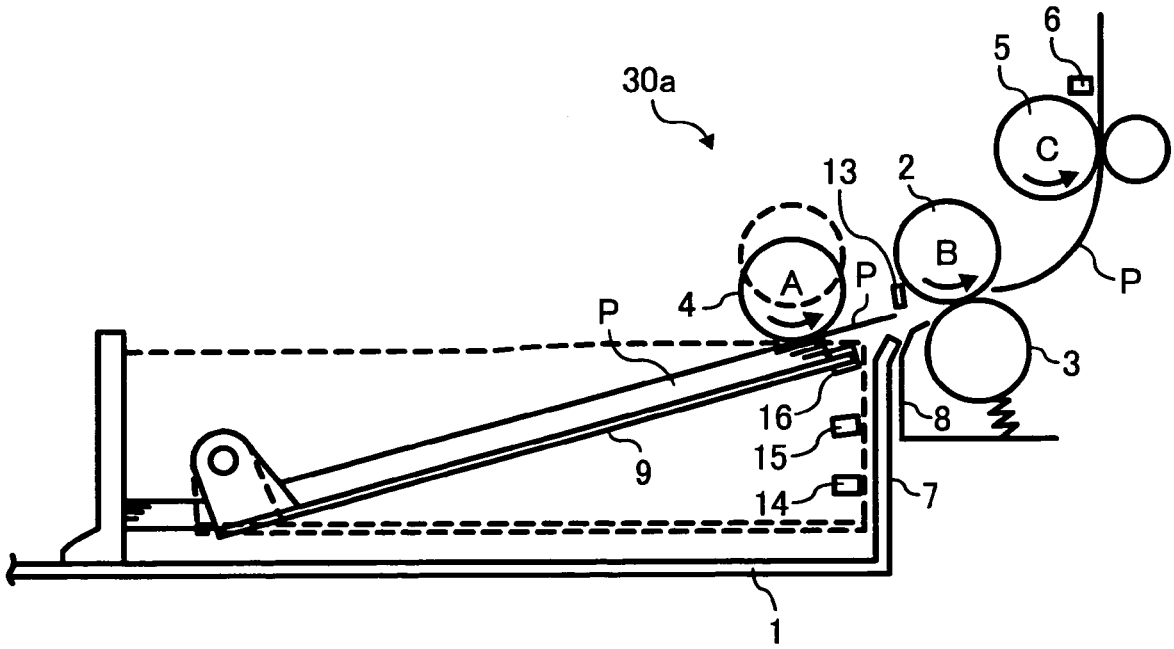
FIG. 6 is a cross-sectional view of an example sheet feeding apparatus according to another exemplary embodiment of the present invention.

FIG. 6 is a cross-sectional view of an example sheet feeding apparatus 30*a* according to another exemplary embodiment of the present invention. As illustrated in FIG. 6, the sheet feeding apparatus 30*a* further includes sensors 14 to 16 (e.g., photo sensors). The sensors 14 to 16 detect the inclination of the bottom plate 9 to detect quantity of sheets P loaded on the bottom plate 9 at several levels (e.g., three levels according to this non-limiting embodiment).

When the sensor 13 does not detect the head of the second sheet P immediately before the tail of the first sheet P passes the nip formed between the feeding roller 2 and the separating roller 3, the sensor 13 may not detect the head of the second sheet P even when a predetermined time period elapses after the pick-up roller 4 contacts the second sheet P placed on the bottom plate 9. In this case, the controller 38 stops driving the feeding roller 2 and moves the pick-up roller 4 away from the second sheet P placed on the bottom plate 9. When the sensors 14 to 16 detect a level indicating a minimum quantity of sheets P loaded on the paper tray 1, the controller 38 also causes the control panel of the image forming apparatus 100 to display the message notifying the operator that no sheet is loaded on the paper tray 1. When the sensors 14 to 16 detect any level indicating quantities other than the minimum quantity of sheets P loaded on the paper tray 1, the controller 38 causes the control panel of the image forming apparatus 100 to display a message notifying the operator that a sheet is jammed.

When the sensor 13 does not detect the head of the second sheet P within the predetermined time period, the controller 38 stops driving the feeding roller 2 and causes the control panel of the image forming apparatus 100 to display that no sheet is loaded on the paper tray 1. Thus, the sheet feeding apparatus 30*a* according to this non-limiting embodiment may not include a mechanism for detecting that no sheet is loaded on the paper tray 1, which is provided in the background sheet feeding apparatus 20*b*, resulting in a decrease of manufacturing cost. In the sheet feeding apparatus 30*a* including the sensors 14 to 16, the controller 38 stops driving the feeding roller 2 and causes the control panel of the image forming apparatus 100 to display the message that no sheet is loaded on the paper tray 1 when the sensor 13 does not detect the head of the second sheet P within the predetermined time period. However, this is limited to a case when the sensors 14 to 16 detect the level indicating the minimum quantity of sheets P loaded on the paper tray 1. Thus, the sheet feeding apparatus 30*a* can detect that no sheet is loaded on the paper tray 1 with an improved accuracy and can avoid a reoccurrence of sheet jam resulting from not removing a previous jammed sheet.

Figure 7A:
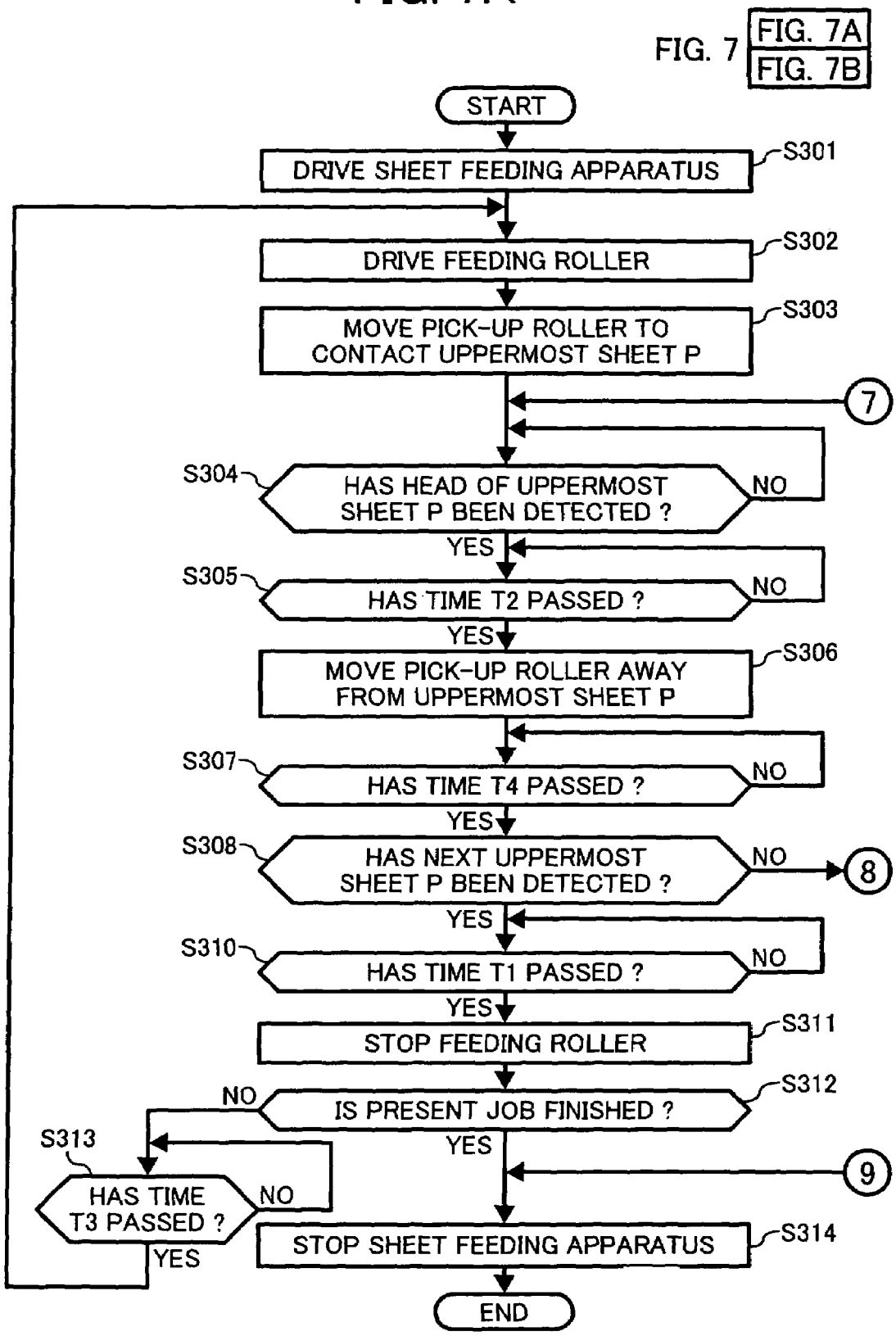
FIGS. 7A and 7B illustrate a flowchart of operations of a sheet feeding apparatus according to another exemplary embodiment of the present invention.
Figure 7B:
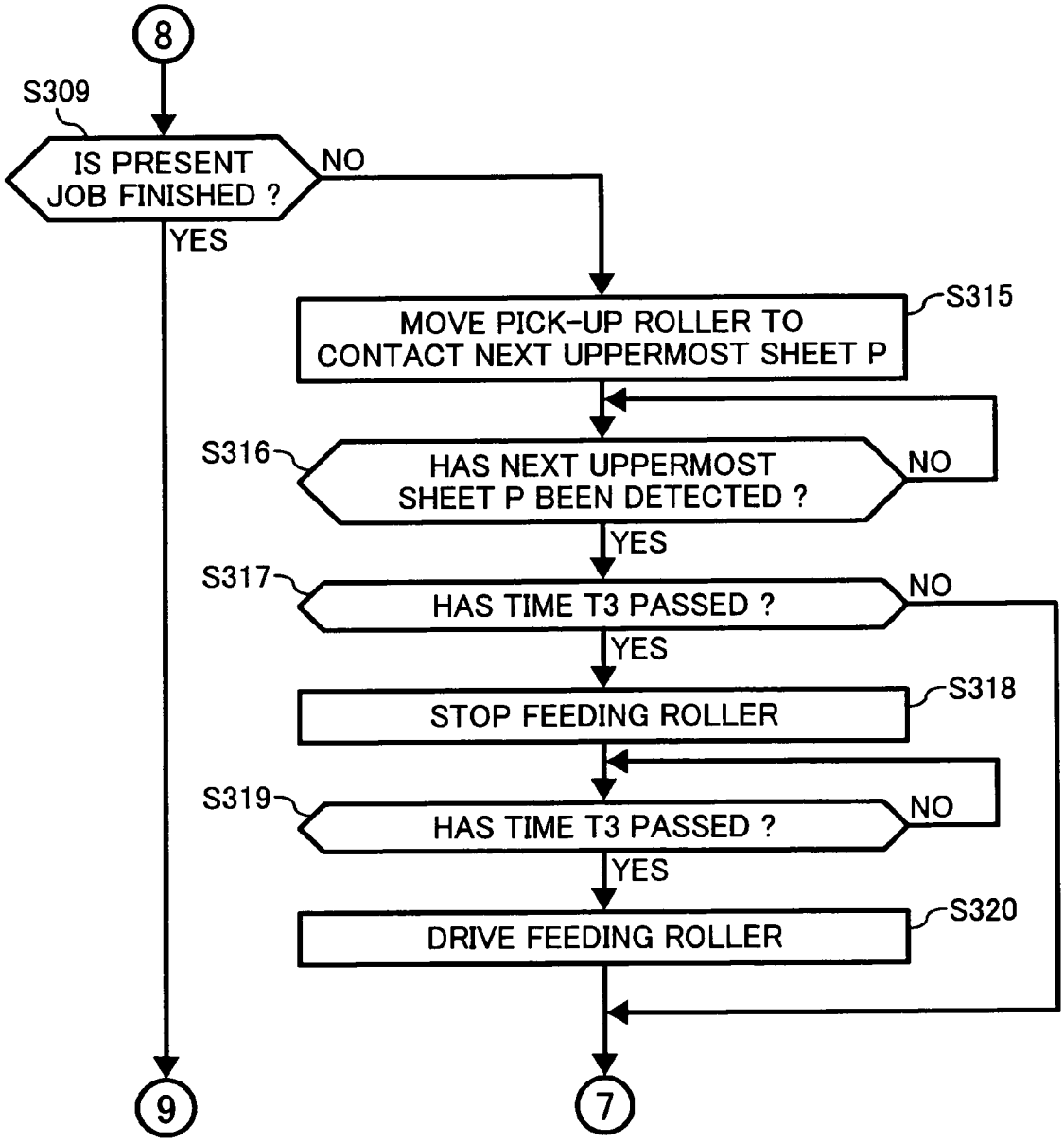

FIGS. 7A and 7B illustrate a flowchart of operations of the sheet feeding apparatus 30 according to another exemplary embodiment of the present invention.

As described above, the feeding start position varies by about 0 mm to about 30 mm in the background image forming apparatus 20*b*. Therefore, the print speed corresponds to a distance between the first and second sheets P, which is calculated by adding the distance corresponding to the time period T10 to the distance of about 45 mm. The time period T10 represents a time period when the first sheet P stops at the registration roller and 45 mm is obtained by adding about 15 mm which corresponds to the time T3 when the tail portion of the first sheet P is conveyed by about 15 mm after passing the nip formed between the feeding roller 2 and the separating roller 3. According to this non-limiting embodiment, however, the sensor 13 is disposed by about X mm in front of the nip formed between the feeding roller 2 and the separating roller 3.

When the sensor 13 detects the head of the second sheet P fed by friction between the first and second sheets P at the time T4 which is immediately after the tail of the first sheet P passes the sensor 13, the controller 38 stops driving the feeding roller 2 at the time T1 which is immediately before the tail portion of the first sheet P passes the nip formed between the feeding roller 2 and the separating roller 3 and starts feeding the second sheet P at the time T3 when the tail portion of the first sheet P is conveyed by about 15 mm after passing the nip formed between the feeding roller 2 and the separating roller 3.

When the sensor 13 does not detect the head of the second sheet P at the time T4 which is immediately after the tail of the first sheet P passes the sensor 13, the controller 38 does not stop driving the feeding roller 2 and causes the pick-up roller 4 to contact the second sheet P placed on the bottom plate 9. When the sensor 13 detects the head of the second sheet P, the controller 38 stops driving the feeding roller 2. The pick-up roller 4 still contacts the second sheet P and starts feeding the second sheet P at the time T3 after the tail of the first sheet P passes the nip formed between the feeding roller 2 and the separating roller 3.

As illustrated in FIGS. 7A and 7B, the sheet feeding apparatus 30 is driven in step S301. In step S302, the feeding roller 2 is driven. In step S303, the pick-up roller 4 contacts an uppermost sheet P (i.e., the first sheet P) of the sheets P loaded on the bottom plate 9. The first sheet P is fed by the pick-up roller 4, the feeding roller 2, the separating roller 3, and the grip roller 5. In step S304, it is determined whether the sensor 6 has detected the head of the fed first sheet P or not is determined. If YES is selected in step S304, whether the time T2 has passed or not in step S305. If YES is selected in step S305, the pick-up roller 4 moves away from the first sheet P in step S306. In step S307, it is determined whether the time T4 has passed or not. If YES is selected in step S307, it is determined whether the sensor 13 has detected a next uppermost sheet P (i.e., the second sheet P) of the sheets P loaded on the bottom plate 9 or not in step S308. In NO is selected in the step S308, it is determined whether a present job is finished or not in step S309. If YES is selected in step S309, the sheet feeding apparatus 30 stops in step S314. If YES is selected in step S308, it is determined whether the time T1 has passed or not in step S310. If YES is selected in step S310, the feeding roller 2 stops in step S311. In step S312, it is determined whether the present job is finished or not. If YES is selected in step S312, the sheet feeding apparatus 30 stops in step S314. If NO is selected in step S312, it is determined whether the time T3 has passed or not in step S313. If YES is selected in step S313, the feeding roller 2 is driven in step S302.

If NO is selected in step S309, the pick-up roller 4 contacts the second sheet P placed on the bottom plate 9 in step S315. In step S316, it is determined whether the sensor 13 has detected the second sheet P or not. If YES is selected in step S316, it is determined whether the time T3 has passed or not in step S317. If NO is selected in step S317, it is determined whether the sensor 6 has detected the head of the fed first sheet P or not in step S304. If YES is selected in step S317, the controller 38 stops driving the feeding roller 2 in step S318. In step S319, it is determined whether the time T3 has passed or not. If YES is selected in step S319, the controller 38 starts driving the feeding roller 2 in step S320. Then, it is determined whether the sensor 6 has detected the head of the fed first sheet P or not in step S304.

If the sensor 13 does not detect the second sheet P, the print speed corresponds to a distance between the first and second sheets P, which is calculated by adding the distance corresponding to the time period T10 to a distance of about X mm plus about 15 mm at a minimum. The time period T10 represents a time period when the first sheet P stops at the registration roller. This distance between the first and second sheets P is equivalent to a maximum distance between the first and second sheets P when the sensor 13 detects the second sheet P.

When the sensor 13 detects the head of the second sheet P after the time T3 when the tail portion of the first sheet P is conveyed by about 15 mm after passing the nip formed between the feeding roller 2 and the separating roller 3, the controller 38 does not stop driving the feeding roller 2 and the feeding roller 2 continues feeding the second sheet P. As described in a previous non-limiting embodiment, the print speed corresponds to a distance between the first and second sheets P, which is calculated by adding the distance corresponding to the time period T11 and the distance corresponding to the time period T10 to the distance of about 30 mm at a maximum. The time period T11 represents a response time of the pick-up roller 4. The time period T10 represents a time period when the first sheet P stops at the registration roller. The distance of about 30 mm is formed between the head of the second sheet P placed on the bottom plate 9 and the nip formed between the feeding roller 2 and the separating roller 3.

According to the previous non-limiting embodiment, if the sensor 13 is disposed by about 12 mm in front of the nip formed between the feeding roller 2 and the separating roller 3 and the time period T11 representing a response time of the pick-up roller 4 is equivalent to a time period required to convey the sheet P by about 3 mm, a minimum distance of about 15 mm can be maintained. However, the sensor 13 may be disposed by a length shorter than 12 mm in front of the nip formed between the feeding roller 2 and the separating roller 3 because a side wall 7 of the paper tray 1 which is inserted from a front of the image forming apparatus 100 may disturb the detection of the head of the sheet P. Varied response times of the pick-up roller 4 may also shorten the minimum distance of about 15 mm. According to this non-limiting embodiment, the minimum distance of about 15 mm can be kept unless the sensor 13 is disposed by about 0 mm in front of the nip formed between the feeding roller 2 and the separating roller 3, regardless of the side wall 7 of the paper tray 1 disturbing the detection of the head of the sheet P or the varied response times shortening the minimum distance of about 15 mm.

A constant-speed motor can be used as a driving motor because it is not necessary to feed the sheet P at an increased speed according to this non-limiting embodiment.

The feeding roller 2 of the sheet feeding apparatus 30 according to this non-limiting embodiment is driven on and off as frequently as the feeding roller 2*b* of the background sheet feeding apparatus 20*b*. However, the maximum distance between the sheets P in the sheet feeding apparatus 30 can be shorter than the maximum distance in the background sheet feeding apparatus 20*b*. The sheet feeding apparatus 30 can also stably create a distance between the sheets P by corresponding to changes of various design parameters, resulting in increased design flexibility and improved reliability of the sheet feeding apparatus 30.

The sheet feeding apparatus 30 according to this non-limiting embodiment includes, as a friction reverse roller, the separating roller 3 which is driven in the direction opposite to the sheet conveyance direction. However, the sheet feeding apparatus 30 may include, as a friction reverse roller, a separating roller which prevents the second sheet P and following sheets P from being fed together with the first sheet P without being driven in the direction opposite to the sheet conveyance direction.

The sheet feeding apparatuses 30 and 30*a* according to the above-described non-limiting embodiments can be applied to image forming apparatuses and printing apparatuses including a copying machine, a printer, and a facsimile machine.

According to the non-limiting embodiments of the present invention, each of the friction reverse roller type sheet feeding apparatuses 30 and 30*a* includes the sensor 13 disposed between the heads of the sheets P loaded on the bottom plate 9 and the separator 23 and configured to detect the sheet P. If the sensor 13 does not detect the second sheet P when the tail of the first sheet P passes the separator 23, the controller 38 does not stop driving the pick-up roller 4 so that the pick-up roller 4 feeds the second sheet P. Thus, each of the sheet feeding apparatuses 30 and 30*a* having a structure similar to that of the background sheet feeding apparatus 20*b* can reduce varied distances between the sheets P without stopping conveyance of the sheets P. Each of the sheet feeding apparatuses 30 and 30*a* can maintain a design benefit of the friction reverse roller type sheet feeding apparatus in which the improved performance in separating the sheets P may not deteriorate even when the heads of the sheets P loaded on the bottom plate 9 and the feeding roller 2 are not accurately positioned to each other, resulting in maintenance of reliability. Moreover, each of the sheet feeding apparatuses 30 and 30*a* can increase the print speed while feeding the sheets P at a speed slower than that of the background sheet feeding apparatus 20*b*. Each of the sheet feeding apparatuses 30 and 30*a* may not include a stepping motor because each of the sheet feeding apparatuses 30 and 30*a* needs not increase the feeding speed, resulting in a decrease of manufacturing cost.

According to the non-limiting embodiments of the present invention, each of the friction reverse roller type sheet feeding apparatuses 30 and 30*a* includes the sensor 13 disposed between the heads of the sheets P loaded on the bottom plate 9 and the separator 23 and configured to detect the sheet P. If the sensor 13 does not detect the second sheet P when the tail of the first sheet P passes the separator 23, the controller 38 does not stop driving the pick-up roller 4 so that the pick-up roller 4 feeds the second sheet P. If the sensor 13 detects the second sheet P, the controller 38 stops driving the pick-up roller 4 until the pick-up roller 4 is ready to feed a following sheet P. Thus, each of the sheet feeding apparatuses 30 and 30*a* having a structure similar to that of the background sheet feeding apparatus 20*b* can stably secure a distance between the sheets P. Each of the sheet feeding apparatuses 30 and 30*a* can maintain a design benefit of the friction reverse roller type sheet feeding apparatus in which the improved performance in separating the sheets P may not deteriorate even when the heads of the sheets P loaded on the bottom plate 9 and the feeding roller 2 are not accurately positioned to each other, resulting in design flexibility and maintenance of reliability. Moreover, each of the sheet feeding apparatuses 30 and 30*a* can increase a print speed while feeding the sheets P at a speed slower than that of the background sheet feeding apparatus 20*b*. Each of the sheet feeding apparatuses 30 and 30*a* may not include a stepping motor because each of the sheet feeding apparatuses 30 and 30*a* needs not increase the feeding speed, resulting in a decrease of manufacturing cost.

The present invention has been described above with reference to specific embodiments. Note that the present invention is not limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

What is claimed is:

1. An image forming apparatus, comprising:

an image forming mechanism configured to form a visible image using toner on a sheet according to image data;

a sheet feeding mechanism configured to feed the sheet to the image forming mechanism and including, a bottom plate configured to load sheets, a first roller configured to feed an uppermost sheet of the sheets loaded on the bottom plate, a separator configured to separate the uppermost sheet from the other sheets when a plurality of sheets are fed by the first roller and including, a second roller connected to the first roller via gears and configured to feed the uppermost sheet fed by the first roller and a third roller disposed to pressingly contact the second roller, and a sensor disposed between heads of the sheets loaded on the bottom plate and the separator and configured to detect the uppermost sheet fed by the first roller; and a controller configured to continue driving of the second roller and to drive the first roller to feed a next uppermost sheet of the sheets loaded on the bottom plate when the sensor does not detect the next uppermost sheet when a tail portion of the previous sheet passes the separator, wherein the controller is configured to stop driving the second roller before the tail of the previous sheet passes a nip formed between the second roller and the third roller when the sensor detects a head portion of the next uppermost sheet.

2. The image forming apparatus according to claim 1, wherein the controller stops driving the first roller and notifies an operator that no sheet is loaded on the bottom plate when the sensor does not detect the head of the next uppermost sheet within a predetermined time period.

3. The image forming apparatus according to claim 1, further comprising:

a sheet level detecting mechanism configured to detect quantity of the sheets loaded on the bottom plate, wherein the controller stops driving the first roller and notifies an operator that no sheet is loaded on the bottom plate when the sensor does not detect the head of the next uppermost sheet within a predetermined time period when the sheet level detecting mechanism detects a minimum quantity of the sheets loaded on the bottom plate.

4. The image forming apparatus according to claim 1, wherein the third roller prevents sheets accidentally fed by the first roller together with the uppermost sheet from being fed by the second roller and wherein the controller stops driving the first roller until the first roller becomes ready to feed a yet next uppermost sheet of the sheets loaded on the bottom plate when the sensor detects the next uppermost sheet when the tail portion of the previous sheet passes the separator.

5. An image forming apparatus, comprising:

means for forming a visible image using toner on a sheet according to image data;

means for feeding the sheet to the means for forming and including, means for loading sheets, first means for feeding an uppermost sheet of the sheets loaded on the means for loading, means for separating the uppermost sheet from the other sheets when a plurality of sheets are fed by the first means and including, second means, connected to the first means by gears, for feeding the uppermost sheet fed by the first means and third means for pressingly contacting the second means, and means for detecting the uppermost sheet fed by the first means and being disposed between heads of the sheets loaded on the means for loading and the means for separating;

means to continue driving of the second means and for driving the first means to feed a next uppermost sheet of the sheets loaded on the means for loading when the means for detecting does not detect the next uppermost sheet when a tail portion of the previous sheet passes the means for separating; and means for stopping driving of the second means before the tail of the previous sheet passes a nip formed between the second means and the third means when the means for detecting detects a head of the next uppermost sheet.

6. An image forming method, comprising:

forming a visible image using toner on a sheet according to image data;

feeding the sheet for the image forming, the feeding step including the sub-steps of feeding with a first roller an uppermost sheet of sheets loaded on the bottom plate, feeding further with a second roller the uppermost sheet fed by the first roller with an assistance of a third roller, the second roller and the third roller forming a separator, and the second roller connected to the first roller via gears;

detecting the uppermost sheet fed by the first roller with a sensor disposed between heads of the sheets loaded on the bottom plate and the separator;

continuing to drive the second roller and to drive the first roller to feed a next uppermost sheet of the sheets loaded on the bottom plate when the sensor does not detect the next uppermost sheet when a tail portion of the previous sheet passes the separator; and stopping driving of the second roller before the tail of the previous sheet passes a nip formed between the second roller and the third roller when the sensor detects a head of the next uppermost sheet.

7. A sheet feeding apparatus, comprising:

a bottom plate configured to load sheets;

a first roller configured to feed an uppermost sheet of the sheets loaded on the bottom plate;

a separator configured to separate the uppermost sheet from the other sheets when a plurality of sheets are fed by the first roller and including, a second roller connected to the first roller via gears and configured to feed the uppermost sheet fed by the first roller and a third roller disposed to pressingly contact the second roller;

a sensor disposed between heads of the sheets loaded on the bottom plate and the separator and configured to detect the uppermost sheet fed by the first roller;

a controller configured to continue driving of the second roller and to drive the first roller to feed a next uppermost sheet of the sheets loaded on the bottom plate when the sensor does not detect the next uppermost sheet when a tail portion of the previous sheet passes the separator, wherein the controller is configured to stop driving the second roller before the tail of the previous sheet passes a nip formed between the second roller and the third roller when the sensor detects a head portion of the next uppermost sheet.

* * * * *